US005473303A

United States Patent [19]

Hohider

[11] Patent Number: 5,473,303

[45] Date of Patent: Dec. 5, 1995

[54] ELECTRICAL LEAD

[75] Inventor: David A. Hohider, Wooster, Ohio

[73] Assignee: Therm-O-Disc, Incorporated, Mansfield, Ohio

[21] Appl. No.: 251,118

[22] Filed: May 31, 1994

[51] Int. Cl.[6] ..... H01H 37/76; H01H 37/64

[52] U.S. Cl. ..... 337/401; 337/407; 337/413

[58] Field of Search ..... 337/180, 298, 337/300, 407, 408, 409, 401, 413

[56] References Cited

U.S. PATENT DOCUMENTS

| | | | |
|---|---|---|---|
| Re. 28,604 | 11/1975 | Kotski . | |
| 3,274,361 | 9/1966 | Ebensteiner . | |
| 3,617,987 | 11/1971 | Sankey . | |
| 3,740,510 | 6/1973 | Grunert . | |
| 3,893,820 | 7/1975 | Davies . | |
| 4,160,968 | 7/1979 | Saini | 337/404 |
| 4,644,118 | 2/1987 | Gengenbach | 200/144 R |
| 4,685,019 | 8/1987 | Needham | 361/2 |
| 4,808,960 | 2/1989 | Nixon | 337/4 |
| 5,260,531 | 11/1993 | Yarbrough | 200/144 R |
| 5,326,946 | 7/1994 | Schaffeler | 200/144 R |

*Primary Examiner*—Leo P. Picard
*Assistant Examiner*—Stephen T. Ryan
*Attorney, Agent, or Firm*—Jones, Day, Reavis & Pogue

[57] ABSTRACT

An elongated electrical lead has a first part of a hard and brittle arc quenching metal integrally joined to an easily bendable second part of a ductile metal. The lead is used in a thermal cutoff with the first part being inside of the thermal cutoff housing and having an end portion defining an electrical contact. The second part of the lead extends outwardly from the thermal cutoff for connecting same in an electrical circuit.

9 Claims, 1 Drawing Sheet

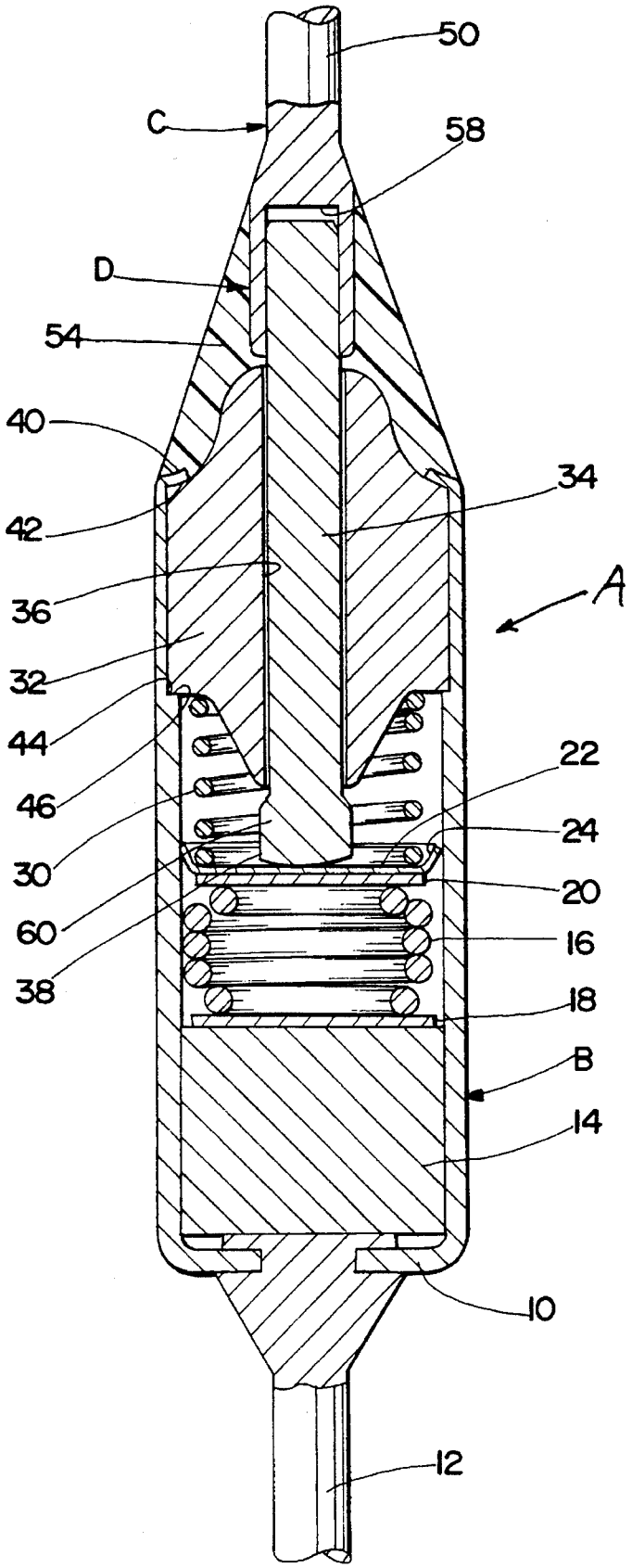
50
C
58
D
54
40
42
34
36
A
32
44
22
46
24
30
20
60
16
38
18
B
14
10
12

ELECTRICAL LEAD

BACKGROUND OF THE INVENTION

This application relates to the art of thermal cutoffs and, more particularly, to thermal cutoffs for interrupting an electrical circuit if responsive to an overtemperature condition. The invention is particularly applicable to thermal cutoffs of the type having a fusible dielectric pellet and will be described with specific reference thereto. However, it will be appreciated that the invention has broader aspects and can be used in other types of thermal cutoffs.

Typical thermal cutoffs have normally closed contacts that open responsive to an overtemperature condition. When the contacts begin to open, arcing may occur and weld the contacts together. It would be desirable to have an arrangement for minimizing the possibility of arcing and welding of the contacts.

SUMMARY OF THE INVENTION

A thermal cutoff of the type described has one contact formed of a hard and brittle arc quenching metal. In a preferred arrangement, the arc quenching contact is made of silver tin oxide.

The arc quenching contact is on a first part of a two-part elongated electrical lead. The two parts are integrally joined, and the first part is of the hard and brittle arc quenching metal while the second part is of a ductile metal.

In a preferred arrangement, the first and second lead parts are integrally joined together at a joint that is encapsulated in sealant at one end of the thermal cutoff. The joint between the two lead parts is defined by at least one of crimping, brazing, soldering or welding.

It is a principal object of the present invention to provide an improved electrical lead having one part of an arc quenching metal and another part of a highly ductile metal.

It is another object of the invention to provide an improved thermal cutoff that minimizes the possibility of contact welding caused by arcing.

BRIEF DESCRIPTION OF THE DRAWING

The drawing shows a cross-sectional elevational view of a thermal cutoff having the improvement of the present application incorporated therein.

DESCRIPTION OF A PREFERRED EMBODIMENT

Referring now to the drawing, wherein the showings are for purposes of illustrating a preferred embodiment of the invention only and not for purposes of limiting same, thermal cutoff A includes a hollow, cylindrical housing B having a bottom end 10 with an elongated lead 12 attached thereto. A fusible dielectrical pellet 14 is positioned within housing B adjacent to bottom end 10 thereof. A coil spring 16 is compressed between washers 18, 20. A star contact 22 slidable within housing B has a plurality of circumferentially-spaced resilient fingers 24 that resiliently engage the internal surface of housing B. A coil spring 30 is compressed between star contact 22 and a ceramic bushing 32.

An electrical lead C includes a first part 34 extending through a central hole 36 in bushing 32. First lead part 34 has a convexly rounded contact end 38 cooperating with star contact 22.

The open end of housing B is crimped inwardly as indicated at 40 against a shoulder 42 on bushing 32. Another shoulder 44 on bushing 32 engages an internal abutment 46 in housing B.

A second part 50 of lead C is joined to first part 34 at a joint D. A sealant such as epoxy 54 encapsulates joint D and covers the outer end portion of bushing 32 and housing crimp 40.

In normal operation, the internal components of thermal cutoff A are arranged as shown in the drawing. A complete electrical path is established from lead 12 to lead C through housing B and contacts 22, 38. If an overtemperature condition occurs, pellet 14 liquifies and allows spring 16 to expand as washer 18 moves toward bottom 10 of housing B. The biasing force of spring 30 then becomes greater than the biasing force of expanded spring 16 and star contact 22 moves away from contact 38. During initial separation of contacts 22, 38, arcing may occur and weld the two contacts together so that separation cannot occur. In accordance with the present application, the possibility of such arcing is minimized by making first lead part 34 of a hard and brittle arc quenching material. The material may be a combination of silver and a non-silver metal oxide. A preferred material is silver tin oxide in a ratio of about 90% silver and 10% tin oxide. However, it will be appreciated that other materials can be used such as silver cadmium oxide and silver nickel oxide.

Second lead part 50 is of a highly ductile material such as copper that may be plated with silver or tin. Second lead part 50 has a length substantially greater than first lead part 34 and is preferably at least two times the length of first lead part 34.

Joint D is shown as being formed by a socket at 58 in second lead part 50 receiving the outer end portion of first part 34. The socket may then be crimped around the outer end of first part 34. It will be recognized that joint D may be formed by brazing, soldering or welding to form an integral and inseparable joint between first and second parts 34, 50.

In the arrangement shown, first lead part 34 has an enlarged head 60 on the inner end portion thereof for preventing outward movement of same through bushing hole 36. In the arrangement where the first lead part 34 is of silver and a non-silver metal oxide, the silver component is preferably at least about 80% by weight of the composite material. The fusible dielectric pellet 14 defines a temperature responsive means for providing separation of contacts 22, 38 by liquifying in response to an overtemperature condition. Pellet 14 may be of many different materials depending upon the desired liquification temperature and two examples include animal protein and caffeine.

Although the invention has been shown and described with respect to a preferred embodiment, it is obvious that equivalent alterations and modifications will occur to others skilled in the art upon the reading and understanding of this specification. The present invention includes all such equivalent alterations and modifications and is limited only by the scope of the claims.

I claim:

1. An elongated electrical lead of first and second parts integrally joined together at a joint located intermediate the opposite ends of the lead, each of said first and second parts forming part of the overall longitudinal length of said lead, said second part having a length substantially greater than the length of said first part, said first part being of a hard and brittle arc quenching metal and said second part being of a ductile metal, said first part having an enlarged terminal end portion that terminates in a convexly rounded terminal end, and said joint defining an enlargement in said lead intermediate the opposite ends thereof.

2. The lead of claim 1 wherein said first part is a composite material of silver and a non-silver metal oxide.

3. A temperature responsive thermal cutoff including a tubular housing having a closed end and an opposite open end receiving a dielectric bushing having a hole therethrough, an elongated electrical lead having a first part of hard and brittle arc quenching metal integrally joined to a second part of ductile metal at a joint, said lead being received in said bushing hole and having an end portion that is formed by said first part and defines a fixed contact projecting externally of said bushing within said tubular housing, a movable contact within said housing normally engaging said fixed contact on said end portion of said first part, and a normally solid meltable dielectric thermal pellet in said housing that melts at a predetermined temperature for providing permanent separation of said contacts, said first part of hard and brittle arc quenching metal inhibiting arcing upon separation of said contacts to thereby inhibit welding together of said contacts.

4. The thermal cutoff of claim 3 wherein said joint is located externally of said bushing opposite from said contact defining end portion and further including a sealant encapsulating said joint and the end portion of said bushing that faces away from said tubular housing.

5. The thermal cutoff of claim 3 wherein said end portion of said first part that defines said fixed contact is enlarged to a size greater than the size of said hole in said bushing.

6. The thermal cutoff of claim 3 wherein said joint is defined by at least one of crimping, brazing, soldering or welding and is enlarged to a size greater than the size of said hole in said busing.

7. The thermal cutoff of claim 3 wherein said first part is a composite material of silver and a non-silver metal oxide.

8. The thermal cutoff of claim 7 wherein said metal oxide comprises tin oxide and said silver comprises at least 80% by weight of said composite material.

9. The thermal cutoff of claim 3 wherein said fixed contact comprises a convexly curved terminal end on an enlarged terminal end portion of said first part and said joint defines an enlargement in said lead, said enlarged terminal end portion and said joint projecting externally of said bushing adjacent opposite ends thereof.

* * * * *